United States Patent [19]

Michael

[11] 4,413,706

[45] Nov. 8, 1983

[54] TREE STEP

[75] Inventor: Bayard H. Michael, Milwaukee, Wis.

[73] Assignee: Total Shooting Systems, Inc., North Fond du Lac, Wis.

[21] Appl. No.: 213,931

[22] Filed: Dec. 8, 1980

[51] Int. Cl.[3] ..... A63B 27/00; A63B 29/04

[52] U.S. Cl. ..... 182/91; 182/92; 248/216.1

[58] Field of Search ..... 182/92, 91, 90; 248/216.1

[56] References Cited

U.S. PATENT DOCUMENTS

| | | | |
|---|---|---|---|
| 1,912,950 | 6/1933 | Moungelis | 248/216.1 |
| 3,298,459 | 1/1967 | Bergsten | 182/92 |
| 3,380,697 | 4/1968 | Melcher | 182/92 |
| 3,498,409 | 3/1970 | Meyer | 182/92 |
| 4,029,355 | 6/1977 | Wilhemsen | 182/91 |

*Primary Examiner*—Reinanldo P. Machado

*Attorney, Agent, or Firm*—Bayard H. Michael

[57] ABSTRACT

The screw at the upper end of the bracket leg is screwed into a tree to support the bracket with the step extending horizontally. When detached the screw can be folded into the leg and moved to a position preventing pivoting the screw relative to the leg. The bracket can now be folded. The screw can also be positioned to extend axially from the leg while unable to pivot with respect to the bracket so the folded bracket serves as a handle for the screw.

11 Claims, 7 Drawing Figures

TREE STEP

FIELD OF THE INVENTION

This invention relates to a bracket which can be fixed to a tree to provide a horizontal step.

BACKGROUND PRIOR ART

Melcher U.S. Pat. No. 3,380,697 shows an L-shaped bracket including an upstanding leg and a foot which serves as a step when the bracket is fixed to a tree. A lag screw is pivoted in the upper end of the leg which has an outwardly facing channel into which the screw can be pivoted when the device is not in use. When the bracket is to be mounted on a tree the lag screw is pivoted 180° to project from the leg along the axis of the leg. The user then forceably drives the point of the screw into the tree to start the screw. The bracket is then rotated to turn the screw into the tree. After the screw has been driven far enough into the tree the bracket is positioned to hang down from the screw with the foot portion extending horizontally to serve as a step.

The manner of starting the screw into the tree by forceably driving or slamming the screw against the tree is fraught with danger in that the bracket can and does pivot relative to the screw and frequently the user cuts his finger against the screw. Another objection with the Melcher device is that the screw is at all times free to pivot relative to the leg of the bracket and can and does move out of the leg to snag or cut the user's pockets or hands during transportation. Finally, the bracket is somewhat bulky and awkward to carry, given the fact that a number of such steps are necessary to be useful and there is no feasible way to nest the devices.

SUMMARY OF THE INVENTION

The object of this invention is to improve upon the prior art and provide a device in which the screw is positively held against pivotal movement during the act of forceably driving the screw against the tree. Another object is to provide a tree step which can be collapsed to a very compact form with the screw enclosed within the collapsed bracket. A further object is to provide a mounting for the screw which holds the screw within the collapsed bracket in such manner that it does not rattle or make noise during transportation which would tend to scare away game, etc. Thus, during transportation the bracket is not noisy in a hunter's pocket and the screw threads are enclosed to prevent injury or damage to the user or his clothing.

DETAILED DESCRIPTION OF THE DRAWINGS

Figure 2:
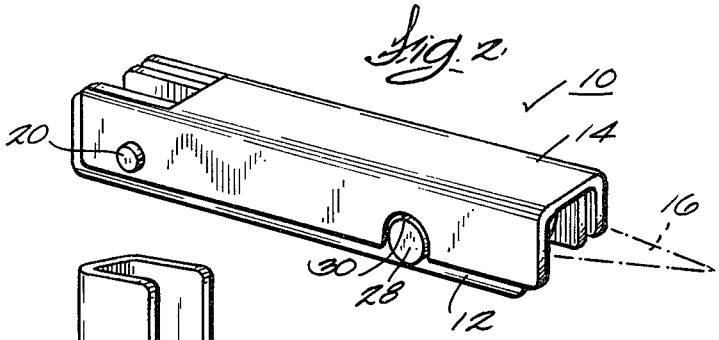
FIG. 2 shows the manner in which the bracket is folded with the screw enclosed inside the folded bracket.
Figure 5:
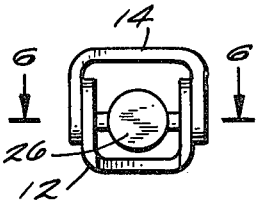
FIG. 5 is an end view of FIG. 2.

The tree step or bracket 10 has an upstanding leg member 12 pivotally connected to step member 14. In use screw 16 at the upper end of leg 12 is threaded into a tree 18 to fix the bracket 10 to the tree with step 14 extending outwardly from the trunk. Step 14 is connected to leg 12 by means of pivot pin 20. The major portion of both the leg and step has a channel or U-shaped cross section. Th sides of the step extend beyond the channel portion of the step to receive the pivot pin 20 with the leg 12 between the extended sides of the step. The left end (FIGS. 2, 3 and 4) of the leg 12 extend beyond the pivot pin far enough so that the end of the leg will strike the web of the channel portion of step 12 to limit movement of the step relative to the leg to about 90°.

The sides of the free or upper end of leg 12 are provided with opposed, generally longitudinally extending slots 22 which receive pivot pin 24 passing through the shank portion 26 of the lag screw 16. Pivot pin 24 has a head 28 on each end outside the sides of the leg 12 to guide the pin in the slot so that it will not cock in the slot or become dislodged from the slots. The pin head 28 also prevents folding the bracket unless the pin is at the inner end of the slots 22 as will be explained more fully hereinafter. When pin 24 is at the inner end of the slots 22 the shank 26 of screw 16 lies so close to the web portion of the channel cross section of leg 12 that the screw cannot pivot relative to the leg. If the pin is at the inner end of the slot 22, the bracket can be folded and the cutouts 30 in the sides of step 14 will fit over and receive the pivot pin heads 28 as shown in FIG. 2. Since both the step and leg have a channel cross section the leg is received inside the step when the bracket is folded and in FIG. 2. the screw is inside the leg. When so folded the bracket is very compact and the sharp threads of the screw are covered.

Figure 3:
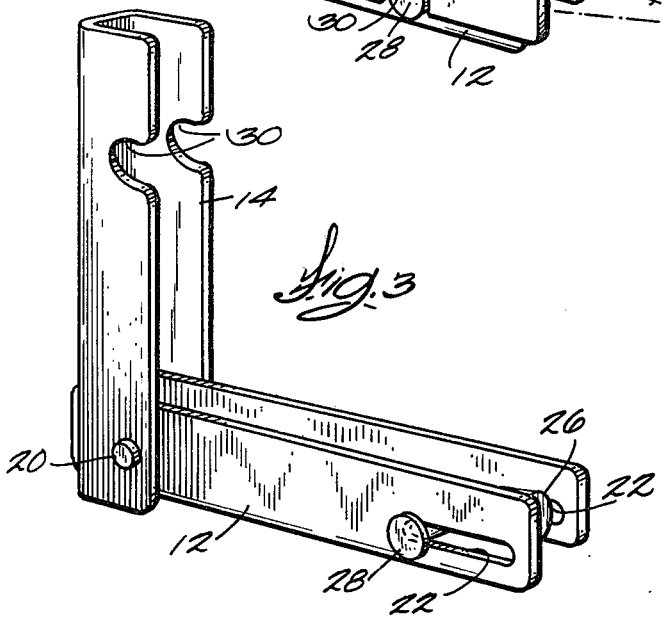
FIG. 3 is a perspective view showing the bracket in the unfolded or active position but with the screw still retained in the leg member.
Figure 6:
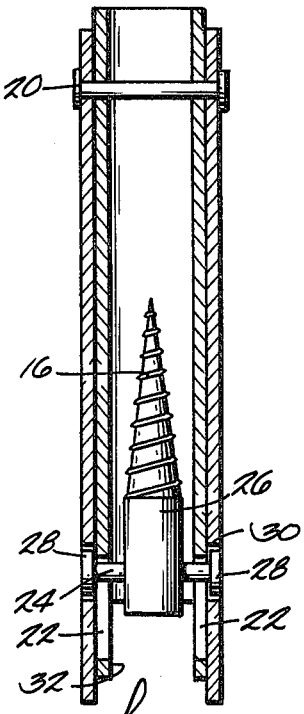
FIG. 6 is a horizontal cross section of FIG. 5 taken on line 6—6.
Figure 1:
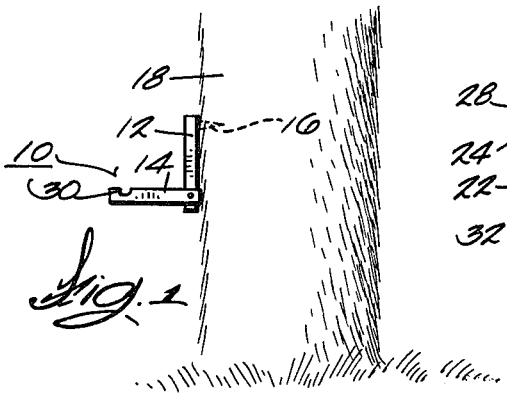
FIG. 1 illustrates the manner in which the device is affixed to a tree to serve as a step.
Figure 4:
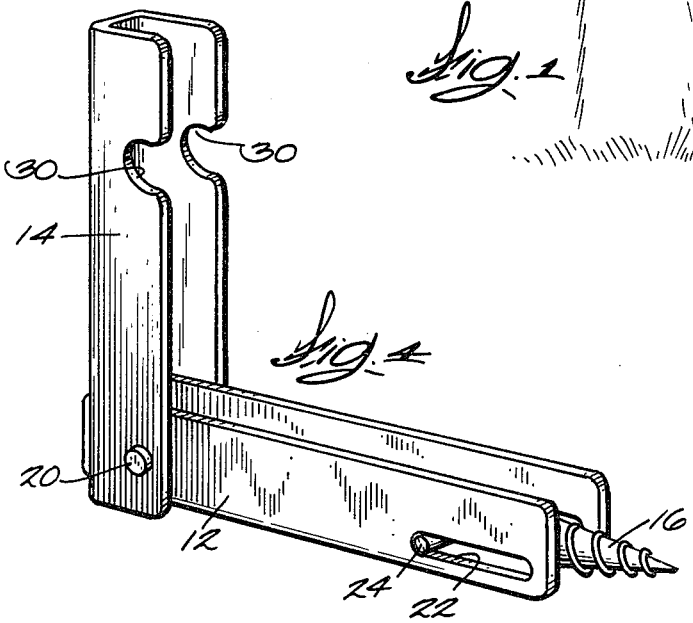
FIG. 4 is similar to FIG. 3 but shows the screw projecting from the leg but in the position in which it is prevented from pivoting.
Figure 7:
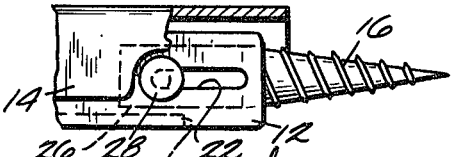
FIG. 7 is a fragmentary view, partly in section, showing the manner in which the screw can be retained in its non-pivoting position by folding the bracket when the screw is retracted in the pivot slots.

When it is desired to put the step into use the bracket is unfolded as shown in FIG. 3. Then the screw and associated pivot pin 24 are moved outwardly to the outer end of slots 22. Since the slots extend into the extended sides of the leg the screw head will now be clear of the channel portion of the leg and can be pivoted relative to the leg without striking the web of the channel. Then, and only then, can the screw be pivoted from its position inside the leg to project from the leg parallel to the leg. The screw is now moved back in the slots to the inner end of the slots and the screw is held against pivoting movement. While the user could now drive the screw against the tree without the screw collapsing there is always a chance the screw could move out in the slots with danger to the user. Therefore, the bracket is preferably (as illustrated in FIG. 2) folded to positively retain the screw in its locked position projecting from the folded bracket as illustrated in dotted lines in FIG. 2. Now the screw cannot move relative to the folded bracket and the user can safely hold the folded bracket and slam it into a tree to start the screw into the wood. Thus the folded bracket serves as a convenient handle for the screw. Then the user turns the bracket to thread the screw into the tree. If additional leverage is required, he can unfold the bracket to gain the additional leverage by turning the screw while applying force to the step portion of the bracket.

When the screw has been driven far enough into the tree and the bracket is in the unfolded position, the bracket can be pivoted relative to the screw so that the screw will now project at 90° from the leg through the notch or space 32 between the extended sides of the leg. Of course, in order to pivot the leg relative to the screw the pivot pin must be at the outer ends of the slots 22.

When the user removes the bracket from the tree the bracket cannot be folded completely until the pivot pin is moved back to the inner ends of the slots 22 since otherwise the sides of the step will strike the heads 28 and prevent fully collapsing the bracket. If the user is foolish, he can, of course, fold the bracket with the screw projecting as in dotted lines in FIG. 2 but most users will have the intelligence to pivot the screw back into the leg and then push the screw and its associated pivot 24 longitudinally into the leg until the pivot is at the inner end of slots 22 permitting the bracket to be folded with the screw totally enclosed and totally safe.

In use the present step will have the open side of the channel-like step facing upwardly and this gives two reasonably sharp edges assuring the user good footing with little danger of slipping. As illustrated the leg nests inside the step but the reverse could be true and the notches in the step could then be somewhat smaller since they would only have to fit over and receive the pin. The notches can be formed in any event to have tight clearance over the heads 28 (or pin 24) to give a detent action positively holding the bracket at the folded position.

I claim:

1. A device to be affixed to a tree comprising an L-shaped bracket having an upstanding support leg member and a horizontal step member and a screw pivotally connected to the upper end of the leg member to attach the bracket to a tree or the like, the improvement comprising, said screw being pivotally connected to the leg member for movement through about 270° from an inactive position in which the screw is parallel to the leg member and points toward said step member to an extended position in which it is generally parallel to and points away from the leg member and then to an active position in which it projects from the leg member at about 90°, said step member being connected to the leg member for limited pivotal movement between a position in which the members are generally at about 90° to each other and a folded position in which the members are parallel, means preventing pivotal movement of the screw relative to the leg member when the members are in said folded position, said screw lying between the members when the screw is in its inactive position and the members are in said folded position.

2. A device according to claim 1 in which the leg member has a U-shaped cross section and the screw is received inside the leg member when the screw is in said inactive position.

3. A device according to claim 2 in which the screw is connected to the leg member by means permitting movement of the screw longitudinally of the leg member between a first position in which the screw cannot pivot and a second position in which the screw is free to pivot.

4. A device according to claim 3 in which the step member has a U-shaped cross section and one member is received inside the other when the members are in said folded position.

5. A device according to claim 4 including means preventing pivoting the members to said folded position when the screw is in said second position.

6. A device according to claim 5 in which the means connecting the screw to the leg member comprises a pivot pin transverse the screw and engaging the sides of the leg member, and including a cut-out in each side of the step member to fit over and receive the pivot pin when the bracket is folded.

7. A device according to claim 6 in which the means connecting the screw to the leg member for limited longitudinal movement comprises longitudinally disposed slots in the sides of the leg member receiving the pivot pin.

8. A device according to claim 7 in which the means preventing movement of the members to said folded position when the screw is in said second position comprise the sides of said step member striking the pivot pin.

9. A device according to claim 8 in which the sides of the upper end of the U-shaped leg member extend beyond the U-shaped leg member and the slots extend into the extended sides so the pivot pin and screw can be pivoted without interference from the U-shaped cross section of the leg member.

10. A device to be affixed to a tree comprising an L-shaped bracket having an upstanding support leg member and a horizontal step member and a screw pivotally connected to the upper end of the leg member to attach the bracket to a tree or the like, the improvement comprising, said step member being connected to the leg member for limited pivotal movement between an operative position in which the members are generally at about 90° to each other and a folded position in which the members are parallel, said screw being pivotally and slidably connected to the leg member for movement from an inactive position in which the screw is parallel to the leg member and points toward said step member to an extended position in which it is generally parallel to and points away from the leg member and has an active position in which it projects from the leg member at about 90° in a direction opposite the operative position of the step member.

11. A device according to claim 10 in which said screw lies between the members when the screw is in its inactive position and the members are in said folded position.

* * * * *